US005731809A

United States Patent [19]

Lin et al.

[11] Patent Number: 5,731,809

[45] Date of Patent: Mar. 24, 1998

[54] ADAPTIVE DISPLAY MEMORY MANAGEMENT SYSTEM

[75] Inventors: Hung-Ming Lin, Hsin Chu Hsien; Mao-Yuan Ku, Chung Li, both of Taiwan

[73] Assignee: Silicon Integrated Systems Corp., Hsin-Chu, Taiwan

[21] Appl. No.: 499,939

[22] Filed: Jul. 10, 1995

[51] Int. Cl.[6] ..... G09G 5/00

[52] U.S. Cl. ..... 345/185; 345/200

[58] Field of Search ..... 345/185, 200, 345/203, 189, 132, 133; 395/509, 515, 517, 520, 521

[56] References Cited

U.S. PATENT DOCUMENTS 4,987,551 1/1991 Garrett, Jr. ..... 345/185

5,291,188 3/1994 McIntyre et al. ..... 345/200

5,450,542 9/1995 Lehman et al. ..... 395/520

5,559,533 9/1996 Hicok et al. .

*Primary Examiner*—Chanh Nguyen

[57] ABSTRACT

An adaptive display memory management system for using idled display memory in a video graphics adapter card as extra system memory of a personal computer is presented. By means of hardware implementation, the memory management system manages the video display memory according to the video display mode and takes advantage of the idled display memory in forming virtual system memory for the computer, so that the working space of executing a user program is increased and the system performance of the computer is enhanced.

2 Claims, 5 Drawing Sheets

| RESOLUTION\COLORS | 16 | 256 | 32768 | 65536 | 1600000 |
|---|---|---|---|---|---|
| 640*480 | 1 MB | 1 MB | 1 MB | 1 MB | 1 MB |
| 800*600 | 1 MB | 1 MB | 1 MB | 1 MB | 2 MB |
| 1024*768 | 1 MB | 1 MB | 2 MB | 2 MB | 4 MB |
| 1280*1024 | 1 MB | 2 MB | 4 MB | 4 MB | |

FIG.2

ADAPTIVE DISPLAY MEMORY MANAGEMENT SYSTEM

FIELD OF THE INVENTION

The present invention relates to a memory management system for display memory, and more particularly to an adaptive display memory management system by using idled display memory in providing more system memory space for user program execution.

BACKGROUND OF THE INVENTION

The basic system memory of a personal computer based on Intel x86 series CPU typically has 1M bytes of random access memory (RAM). A significant amount of the system memory space is reserved for the basic I/O system, adapter ROM, and video memory for the normal operation of the computer.

According to the map of the memory allocation in a typical IBM personal computer or compatible computer operating in Microsoft Disk operating System (abbreviated MS-DOS), the MS-DOS allows access only to up to 640K bytes of the system memory. The remainder of the system memory is dedicated to space for video memory (i.e. display memory), video ROM, hard disk ROM, ROM BIOS, and the ROM for others of the computer. For example, the display memory is located between 640K and 768K, and the video adapter ROM is located between 768K and 832K.

In the field of computer technique, the first continued 640K system memory is called conventional memory, and the memory above 1024K is called extended memory.

In general, only the conventional memory, i.e. 640K bytes memory, is available for the DOS operating system and user's programs. The Operating system and other resident programs take some of the memory space. Therefore, the remaining system memory space for executing a user program is quite small. Users often discover that the computer is incapable of or very slow in running Windows or other game programs because of the shortage in working memory space.

Various memory management techniques are therefore developed to expand the memory available to PC programs. By means of memory management either in hardware or software implementation, the commercial memory management system may effectively provide access to more expanded memory and better memory management capabilities. Expanded memory on Intel microprocessor 80386 and newer processors is most often implemented in software by conversion of extended memory.

Expanded memory gives the PC access to more than 640K conventional system memory by dividing the additional memory into 16K logical pages. Any logical page can be mapped into a Page Frame allocated in the system memory, which can contain from 0–12 logical pages of expanded memory at any one time. The page frame is located within the 384K of memory above the conventional memory 640K, typically between 768K and 832K.

Memory management programs such as EMM386.EXE provided by DOS can be executed in CONFIG.SYS to expand the conventional memory space. The EMM386.EXE is an expanded memory manager written for the Intel 80386 and 80486. The memory optimization program MEMMAKER.EXE of DOS can also help to optimize the system memory and save some conventional memory space. However, the memory space available for executing a user program remains very limited.

One approach to solving the above mentioned problem is to remove the resident programs. Nevertheless, the increase in working space is limited to the available memory. The other approach is to install more memory in the computer. Some of the personal computers may be purchased with more system memory such as 4M bytes or 8M bytes. The cost of memory represents a big portion of the computer cost in that memory is very expensive. In addition, computers that come with 4M bytes or 8M bytes memory may not be necessary for a lot of users. In many cases, extra memory is simply wasted in the computer system.

As described above, the display memory is located between 640K and 768K, and the video adapter ROM is located between 768K and 832K of the system memory in the typical IBM PC memory map. In an alternative representation, the personal computer may use segments and offsets to address memory. Normally, the segment part and offset part of the address are 4-digit hexadecimal numbers. The hex number for 640K is A000. The 640K boundary expressed in segment:offset terms is A000:0000.

The display memory on an EGA or VGA display is located just above the 640K DOS memory boundary, and is sometimes referred to as occupying the A-range of memory. The A-range starts at the 640K boundary and extends for 64K bytes to the beginning of the B-range. The adapter ROM is located in the C-range of memory, starting at 768K. Therefore, it is understood that the memory allocations A000:0000–A000:FFFF and B000:0000–B000:FFFF are reserved for the display memory and video adapter functions.

The video RAM or display memory is used to store information to be processed by the video adapter for placement on the display screen. The amount and exact location of the video memory depends on the display video mode.

The most commonly encountered video modes, particularly on IBM PC and compatible computers, are text mode and graphics mode. Other video modes are also possible and are defined by number of colors, resolution, or a combination of the two. VGA card is a high resolution text and graphics system supporting color and video standards.

The standard video graphics mode originally defined by the IBM standard has 64K memory space because it was defined for the 320×200 resolution and 256 color video mode. Most of the recent software programs require much higher resolution and more colors for displaying visual information and graphical user interface. The demand of 640×480 or 800×600 resolution and 256 colors video graphics adapter (VGA) becomes more and more. Therefore, almost all VGA cards in the market today provide at least 1M bytes of display memory. To overcome the 64K memory space defined in the IBM standard, segment selector is used to address and select different segment of the 1M bytes video display memory. They can further be extended to include 2M or even 4M bytes of display memory.

Although the VGA card in a personal computer provides a lot of video display memory, the memory is quite often not fully used while a user's program is running. Therefore, the unused display memory on the video adapter card may be considered an idled display memory. For example, 4M bytes of total display memory are installed on the video adapter card, but only 1M byte of display memory is required in an 800×600 resolution and 256 colors video display situation. The remaining 3M bytes of display memory are unused. We may consider the unused display memory as idled display memory. Obviously, it will be advantageous to use the idled display memory as a portion of the system memory.

SUMMARY OF THE INVENTION

Consequently, the primary object of the present invention is to provide an adaptive display memory management system capable of using the idled display memory in the video adapter card for providing more system memory space for user program execution. The idled display memory is added to the main system memory, so that the computer thinks the transferred idled display memory as virtual system memory. The virtual memory allows an application to see the system as providing a larger uniform system memory for the computer.

The other object of the present invention is to overcome the above system memory shortage problem. In the personal computer, an add-on video graphics adapter (VGA) is usually available to provide its interface to a video monitor for displaying computer output. A high resolution video mode usually requires more than 2M bytes of display memory in the VGA card. This invention provides an adaptive memory management system to take advantage of the display memory in the VGA card and create more system memory space for executing user programs.

By means of hardware implementation, the present invention is capable of using the idled display memory as extra system memory for the computer. It manages the display memory according to the video display requirement of the program being executed. Unused memory is managed to serve as virtual system memory for the computer. The invention increases the overall system memory space for program execution. The overall computer performance is greatly enhanced.

The principle and other advantages of this invention can further be understood by the following detailed description and the accompanied figures.

BRIEF DESCRIPTION OF THE DRAWINGS

FIG. 2 shows the size of required display memory with respect to the video modes and colors;

DETAILED DESCRIPTION OF THE PREFERRED EMBODIMENT

Figure 1:
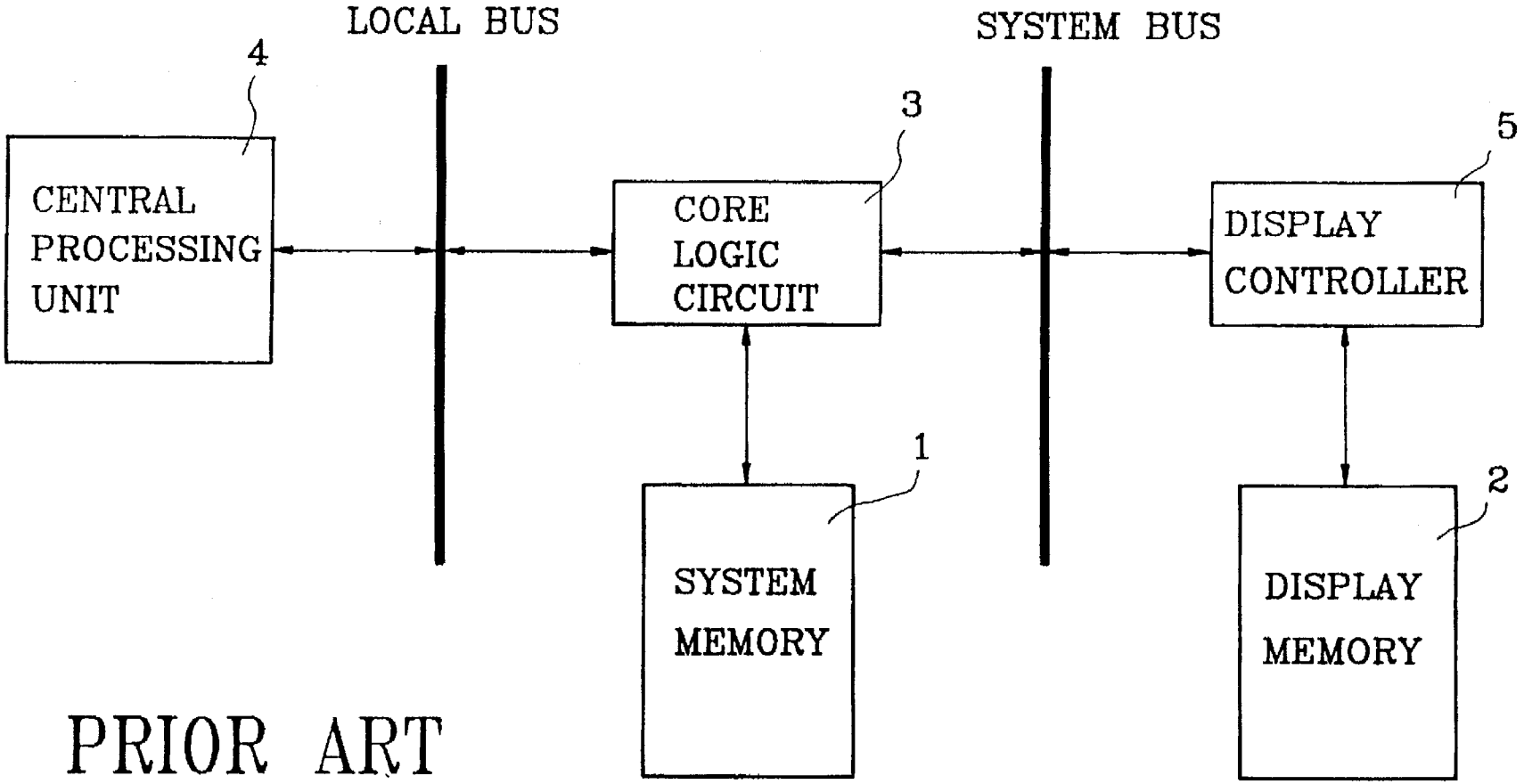
PRIOR ART FIG.1
FIG. 1 shows a simplified system block diagram of a typical personal computer.

The system block diagram of a conventional personal computer is shown in FIG. 1. The system mainly includes a system memory 1, a display memory 2, a core logic circuit 3, a central processing unit 4, and a display controller 5. The system memory 1 resides on the motherboard of the computer system to store operating system and other resident programs. The main memory 4 also provides working space for executing user's programs.

The core logic circuit 3 is provided to manage the system memory 1 under control of the central processing unit 4, and also manage the display memory 2 via the display controller 5. The central processing unit (CPU) 4 accesses data in the system memory 1 through local bus. Some data are also sent to display controller 5 through the core logic circuit 3 and system bus.

The display memory 2 is used to store information to be processed by the display controller 5 for placement on a display screen (not shown). The display controller 5 has a video processor and it is usually in a form of video adapter card suitable to be plugged on the motherboard of the computer. It is known that the display memory is a special type of dynamic RAM(DRAM) used in high-speed video applications. Normally, the video memory 2 can be accessed only by the display controller 5. The display controller 5 is capable of handling the control signal (such as Memory Read/Write, IO Read/Write, etc.) from central processing unit 4 via the core logic circuit 3.

In order to support video display modes that have high resolution, the demand of high capacity display memory becomes more and more.

FIG. 2 shows the various requirements in display memory with respect to both resolution and colors. Normally, higher resolution and more colors provide better video quality. Correspondingly, more display memory is required for the higher resolution and more colors. For examples, 1M byte of display memory is required in a 800×600 resolution and 32768 colors video display. A video display with 1280×1024 resolution and 32768 colors requires 4M bytes of display memory.

Figure 3:
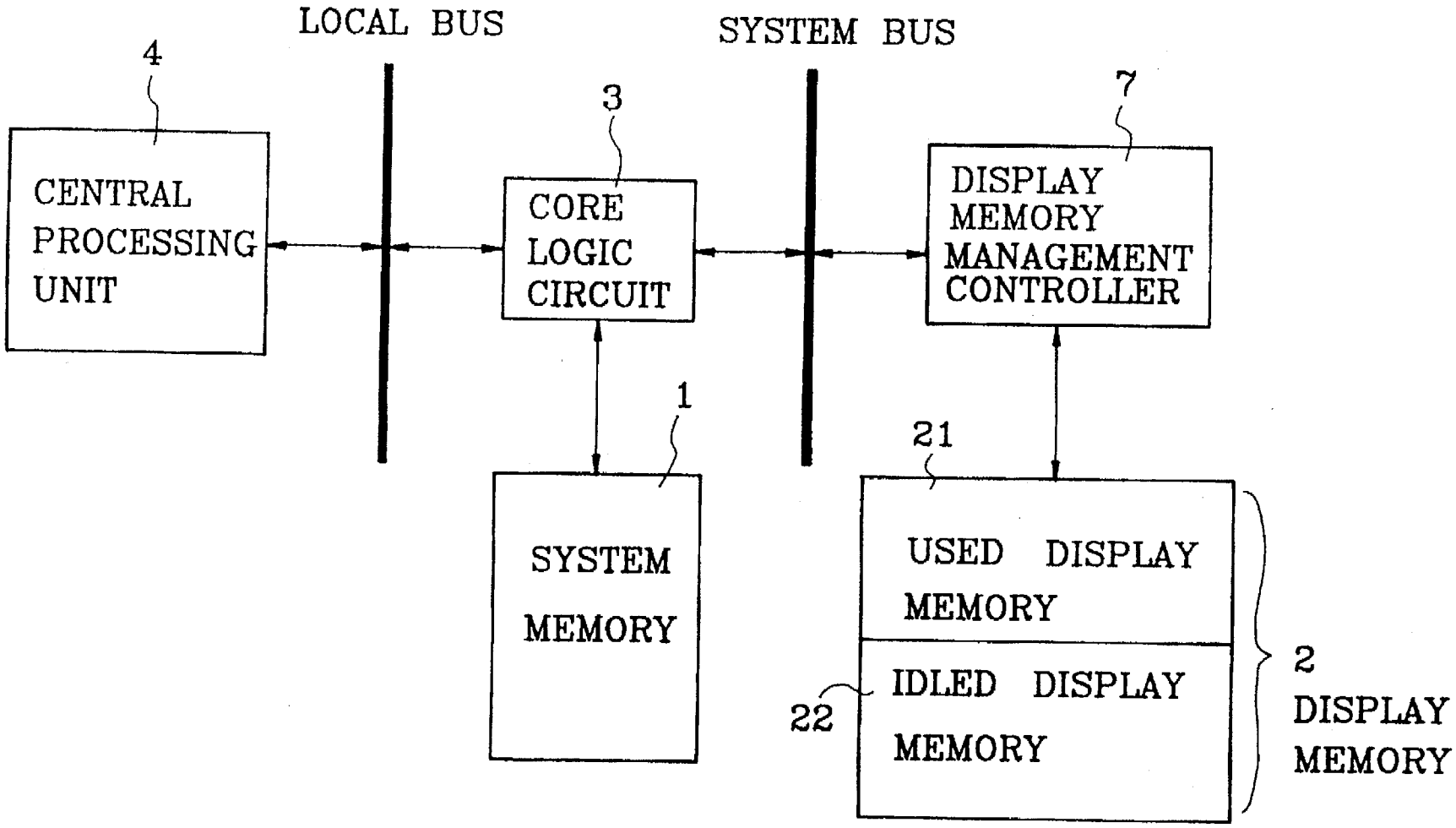
FIG. 3 shows the simplified system block diagram of the present invention.
Figure 4:
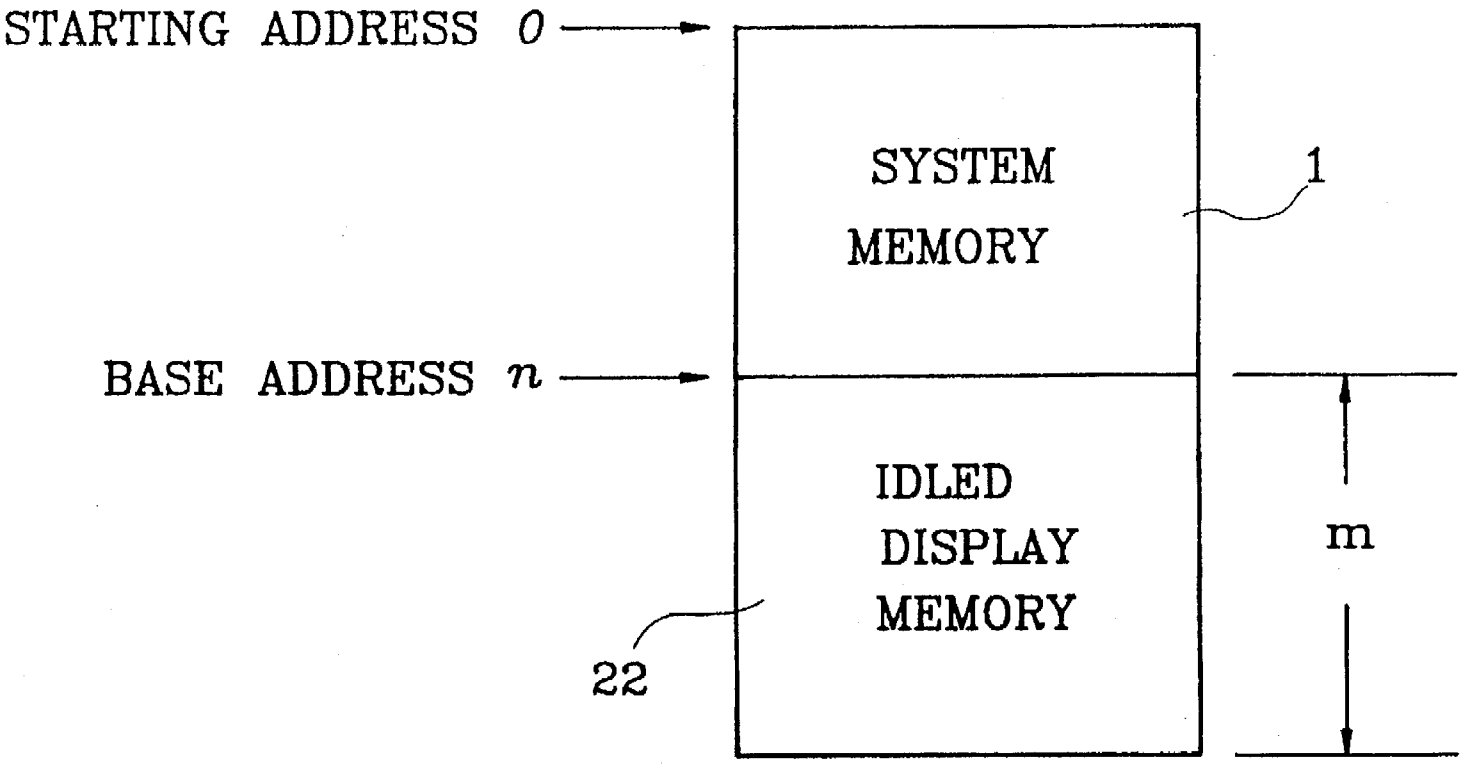
FIG. 4 illustrates the idled display memory is added to the system memory serving as virtual system memory.

FIG. 3 shows the simplified system block diagram of the present invention. As stated above, dependent on the video display mode in use, display memory often is not fully utilized. As shown in FIG. 3, there are usually some idled display memory 22 in the display memory 2. The idled display memory 22 is used as part of the system memory. These idled display memory can be regarded as virtual system memory. The size of the system memory is therefore augmented to increase the working space of executing a user's program. As shown in FIG. 4, in addition to the system memory, virtual system memory 22 is included as part of the total system memory conceptually. FIG. 4 illustrates the idled display memory is added to the system memory serving as virtual system memory.

Figure 5:
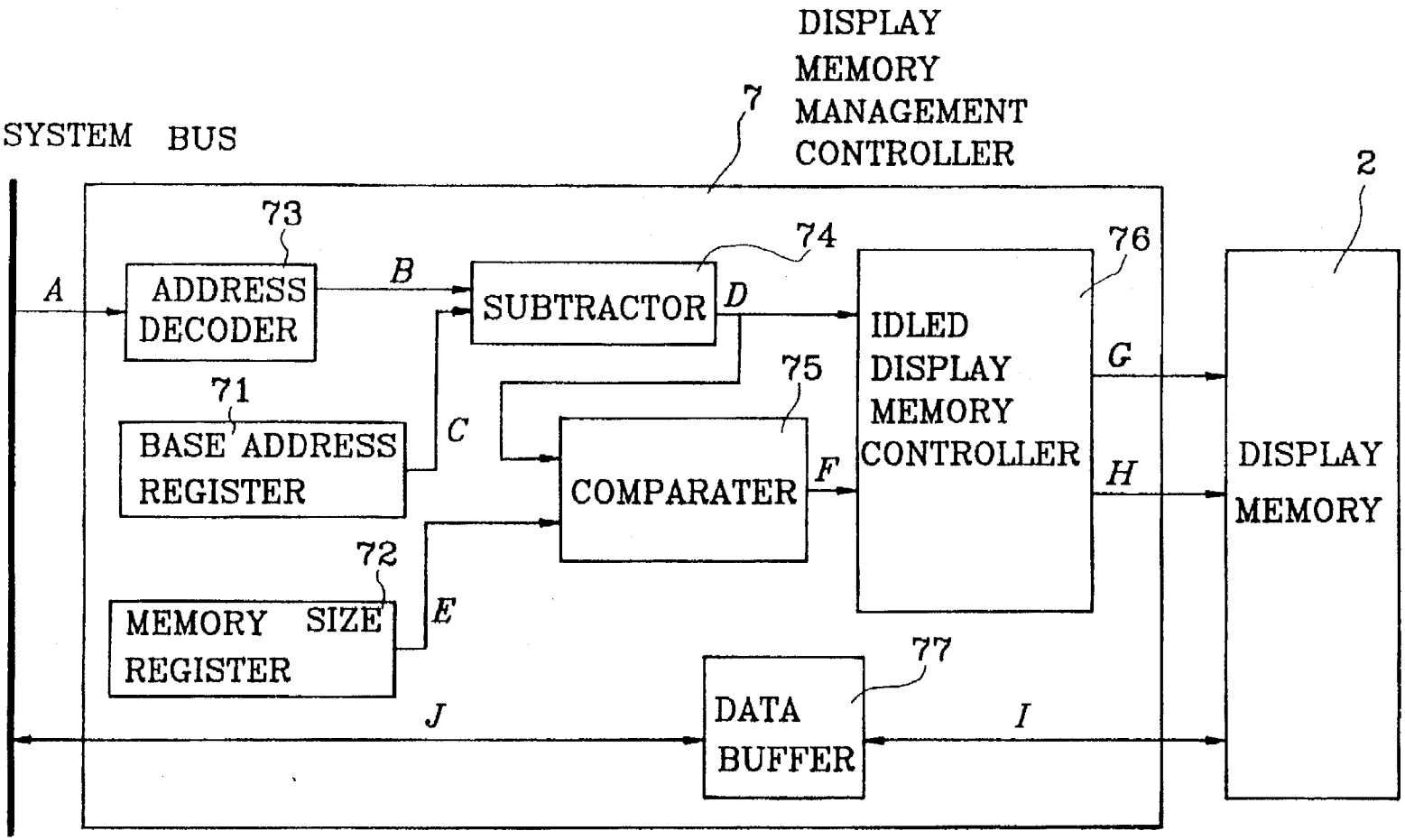
FIG. 5 shows a circuit diagram of the display memory management controller shown in FIG. 3 in more detail.

FIG. 5 shows a circuit diagram of the display memory management controller 7 shown in FIG. 3 in more detail. In accordance with the present invention, the display memory management controller 7 consists of a base address register 71, a memory size register 72, an address decoder 73, a subtractor 74, a comparator 75, a display memory controller 76, and a data buffer 77.

As shown in FIG. 5, there are registers in the display memory management controller 7 for addressing the idled display memory to be transferred as virtual system memory to the system memory. The base address register 71 sets a starting or base address of the idled display memory. The memory size register 72 sets the length or size of the virtual memory.

For example, as shown in FIG. 4, the system memory 1 has a starting address 0 and the idled display memory 22 has m megabytes starting at a base address n. Therefore, in this example the base address register 71 is set to n and the memory size register 72 is set to m.

When the computer system tries to fetch a data at an address above its system memory, the address decoder 73 gets an address signal A from the system bus and decodes it into a decoded address signal B as shown in FIG. 5. The base address register 71 sends out an base address signal C that has been set the base address value n for the idled display memory. The decoded address signal B and the base address signal C are subtracted in the subtractor 74 to confirm that the address obtained from the system bus is indeed in the range of the virtual system memory. The difference signal D represents the address of the desired virtual system memory in the display memory.

The difference signal D is further compared with the memory size signal E that represents the size of the available idled display memory in the comparator 75. The comparator 75 sends a control signal F to the idled display memory controller 76. If the signal D is greater than the signal E, the idled display memory controller 76 does not output any signal because it indicates that the requested memory address has exceeded the available virtual system memory address. If the signal D output from the subtractor 74 is less than the signal E output from the memory size register 72, the idled display memory controller 76 converts the signal D into an address signal G and generates the address signal G to the display memory 2 for addressing the idled display memory. In the mean time, the idled display memory controller 7 also issues a control signal H to read or write the display memory 2.

Furthermore, because the data transfer speed between the system bus and the display memory management controller 7 is different from the transfer speed between the display memory management controller 7 and the display memory 2, a data buffer 77 is provided between the system bus and the display memory 2 to buffer the data. When data are fetched from the display memory 2, they are sent to the data buffer 77 before being sent to the system bus. When data are written to the display memory, they are written to the data buffer 77 and then written to the display memory.

The operation of the adaptive memory management system in accordance with the present invention can be summarized as follows:

a. receive the address signal on the system bus;

b. decode the received address signal in the address decoder and generate an decoded address signal;

c. subtract the base address of the base address register from the decoded address signal;

d. perform step e if the result from step c is less than the size of the virtual system memory, otherwise perform step a;

e. convert the result from step c to an address of the idled display memory, and generate a control signal to the display memory;

f. read or write the addressed idled display memory according to the control signal from the idled display memory controller; and g. repeat step. a.

The above procedure can be used to effectively take advantage of the idled display memory and use them as virtual system memory to the originally installed system memory, so as to expand working space of executing a program and enhance the system performance. In the above description, the adaptive memory management system of the present invention may be designed in the graphics chip of a video adapter card. Furthermore, other interface chips in the computer system such as IDE chip can be designed to include the memory management system of the present invention as well.

Although only the preferred embodiments of this invention were shown and described in the above description, it is requested that any modification or combination that comes within the spirit of this invention be protected.

What is claimed is:

1. An adaptive display memory management system for using idled display memory in a video adapter card as virtual system memory for a computer system, comprising:

a decoder for receiving and decoding an address signal from the computer into a decoded address signal;

a base address register for storing a base address of the idled display memory;

a memory size register for storing a virtual memory size;

a subtractor having a first input connected to said decoder, a second input connected to said base address register, and an output, said subtractor subtracting the base address of the base address register from the decoded address signal of the decoder;

a comparator having a first input connected to said subtractor output, a second input connected to said memory size register, and an output, said comparator comparing said subtractor output with said virtual memory size; and an idled display memory controller having a first input connected to said subtractor output and a second input connected to said comparator output, said controller having an address output and a read/write control signal for accessing the idled display memory;

wherein said idled display memory controller converts said subtractor output into an address output for accessing said idled display memory if said subtractor output is less than said virtual memory size.

2. A method for using an idled display memory of a display memory in a video adapter card as virtual system memory for a computer system comprising the steps of:

a. receiving an address signal from the computer;

b. decoding and converting the received address signal into a decoded address signal;

c. subtracting a base address of virtual system memory of said computer system from the decoded address signal;

d. performing step e if the result from step c is less than the size of said virtual system memory, otherwise perform step a;

e. converting the result from step c into an address of said idled display memory, and generating a control signal to the display memory;

f. using said control signal and said address of the idled display memory to access said idled display memory; and g. continuing step a;

wherein said idled display memory serves as said virtual system memory for the computer system.

* * * * *